US006050783A

United States Patent [19]

Ogura

[11] Patent Number: 6,050,783

[45] Date of Patent: Apr. 18, 2000

[54] RECIPROCATING COMPRESSOR IN WHICH A BLOWBY GAS CAN BE RETURNED INTO A SUCTION CHAMBER WITH A LUBRICATING OIL WITHIN A CRANK CHAMBER KEPT AT A SUFFICIENT LEVEL

[75] Inventor: Toshiyuki Ogura, Gunma, Japan

[73] Assignee: Sanden Corporation, Gunma, Japan

[21] Appl. No.: 09/003,950

[22] Filed: Jan. 8, 1998

[30] Foreign Application Priority Data

Jan. 10, 1997 [JP] Japan ..... 9-003306

[51] Int. Cl.[7] ..... F04B 1/12

[52] U.S. Cl. ..... 417/269; 92/71

[58] Field of Search ..... 417/269; 92/71

[56] References Cited

U.S. PATENT DOCUMENTS

| | | | |
|---|---|---|---|
| 4,005,948 | 2/1977 | Hiraga et al. . | |
| 4,236,878 | 12/1980 | Terauchi . | |
| 4,314,796 | 2/1982 | Terauchi . | |
| 4,444,549 | 4/1984 | Takahashi et al. . | |
| 4,746,275 | 5/1988 | Iwamori et al. | 417/269 |
| 5,393,204 | 2/1995 | Kawahara . | |
| 5,562,425 | 10/1996 | Kimura et al. | 417/266 |

FOREIGN PATENT DOCUMENTS

| | | | |
|---|---|---|---|
| 4302388 | 8/1993 | Germany | 417/269 |
| 777158 | 3/1995 | Japan . | |
| 7189897 | 7/1995 | Japan . | |

*Primary Examiner*—Charles G. Freay
*Assistant Examiner*—Cheryl J. Tyler
*Attorney, Agent, or Firm*—Baker Botts, L.L.P.

[57] ABSTRACT

A plurality of cylinder bores are circumferentially formed in a cylinder block around its center axis to receive a plurality of pistons, respectively. The cylinder block has one end closed by a front housing to define a crank chamber. The cylinder block has another end closed by a rear member in which a discharge chamber and a suction chamber are formed. A drive shaft penetrates the front housing and has one end supported by the cylinder block through a block-side bearing. Following a rotary motion of the drive shaft, a swash-plate element drives a reciprocating motion of the piston within the bore. A blowby gas leaking into the crank chamber is introduced into the suction chamber a gas passage through an gap inevitably left between the drive shaft and the block-side bearing back.

8 Claims, 5 Drawing Sheets

RECIPROCATING COMPRESSOR IN WHICH A BLOWBY GAS CAN BE RETURNED INTO A SUCTION CHAMBER WITH A LUBRICATING OIL WITHIN A CRANK CHAMBER KEPT AT A SUFFICIENT LEVEL

BACKGROUND OF THE INVENTION

This invention relates to a reciprocating compressor for use in an automobile air conditioner or the like and, in particular, to a reciprocating compressor of a structure in which a rear housing is formed at one axial end of a cylinder block and a discharge chamber and a suction chamber are formed in the rear housing at an inner area and an outer area in a radial direction thereof, respectively.

A conventional reciprocating compressor of the type is disclosed, for example, in a Japanese Unexamined Patent Publication (JP-A) No. 189897/1995 and comprises a swash-plate element of an integral structure, as will later be described in detail. Another reciprocating compressor of the type is disclosed in Japanese Unexamined Patent Publication (JP-A) No. 77158/1995 and comprises another swash-plate element formed by a combination of a rotor and a wobble plate as separate components, as will later be described in detail also.

In each of the above-mentioned conventional reciprocating compressors, a gas passage penetrating through a cylinder block is formed between a suction chamber and a crank chamber in order to return a blowby gas leaking from the suction chamber back into the crank chamber.

During operation of each of the above-mentioned conventional reciprocating compressors, centrifugal force is produced following a rotary motion of the swash-plate element. Under the centrifugal force, a lubricating oil present within the crank chamber or contained in the blowby gas is splashed towards an inner peripheral surface of the crank chamber. The lubricating oil thus splashed throughout the crank chamber serves to lubricate various driving elements.

However, the lubricating oil splashed towards the inner peripheral surface of the crank chamber often flows out to the suction chamber together with the blowby gas through the gas passage having an open end formed in the vicinity of the inner peripheral surface. This results in shortage of the lubricating oil within the crank chamber. In the worst case, defective lubrication results in abrasion and seizure of the driving elements.

SUMMARY OF THE INVENTION

It is therefore an object of this invention to provide a reciprocating compressor capable of returning a blowby gas into a suction chamber with a lubricating oil within a crank chamber kept at a sufficient level.

It is another object of this invention to provide a reciprocating compressor capable of returning a blowby gas from a crank chamber into a suction chamber without requiring a through hole penetrating a cylinder block in an axial direction thereof.

Other objects of this invention will become clear as the description proceeds.

According to an aspect of this invention, there is provided a reciprocating compressor comprising a cylinder block having a cylinder bore and a bearing hole, a piston disposed in the cylinder bore, a front housing placed at one end of the cylinder block in an axial direction to define a crank chamber in cooperation with the cylinder block, a drive shaft penetrating the front housing and driven to have a rotary motion, a block-side bearing supporting the drive shaft in the bearing hole, a swash-plate element placed in the crank chamber and responsive to the rotary motion of the drive shaft for making the piston have a reciprocating motion within the cylinder bore, a rear member placed at another end of the cylinder block in the axial direction and having a discharge chamber and a suction chamber which are communicable with the cylinder bore in response to the reciprocating motion of the piston, and gas returning means connected to the bearing hole and the suction chamber for returning a blowby gas, which leaks into the crank chamber from the bore, back into the suction chamber through a gap inevitably left between the drive shaft and the block-side bearing.

According another aspect of this invention, there is provided a reciprocating compressor comprising a cylinder block having a plurality of cylinder bores and a bearing hole, a plurality of pistons disposed in the cylinder bores, respectively, a front housing placed at one end of the cylinder block in an axial direction to define a crank chamber in cooperation with the cylinder block, a drive shaft penetrating the front housing and driven to have a rotary motion, a block-side bearing supporting the drive shaft in the bearing hole, a swash-plate element placed in the crank chamber and responsive to the rotary motion of the drive shaft for making each of the pistons have a reciprocating motion within each of the cylinder bores, a rear member placed at another end of the cylinder block in the axial direction and having a discharge chamber and a suction chamber which are communicable with each of the cylinder bores in response to the reciprocating motion of the piston, and gas returning means connected to the bearing hole and the suction chamber for returning a blowby gas, which leaks into the crank chamber from the bore, back into the suction chamber through a gap inevitably left between the drive shaft and the block-side bearing.

DESCRIPTION OF THE PREFERRED EMBODIMENTS

Figure 1:
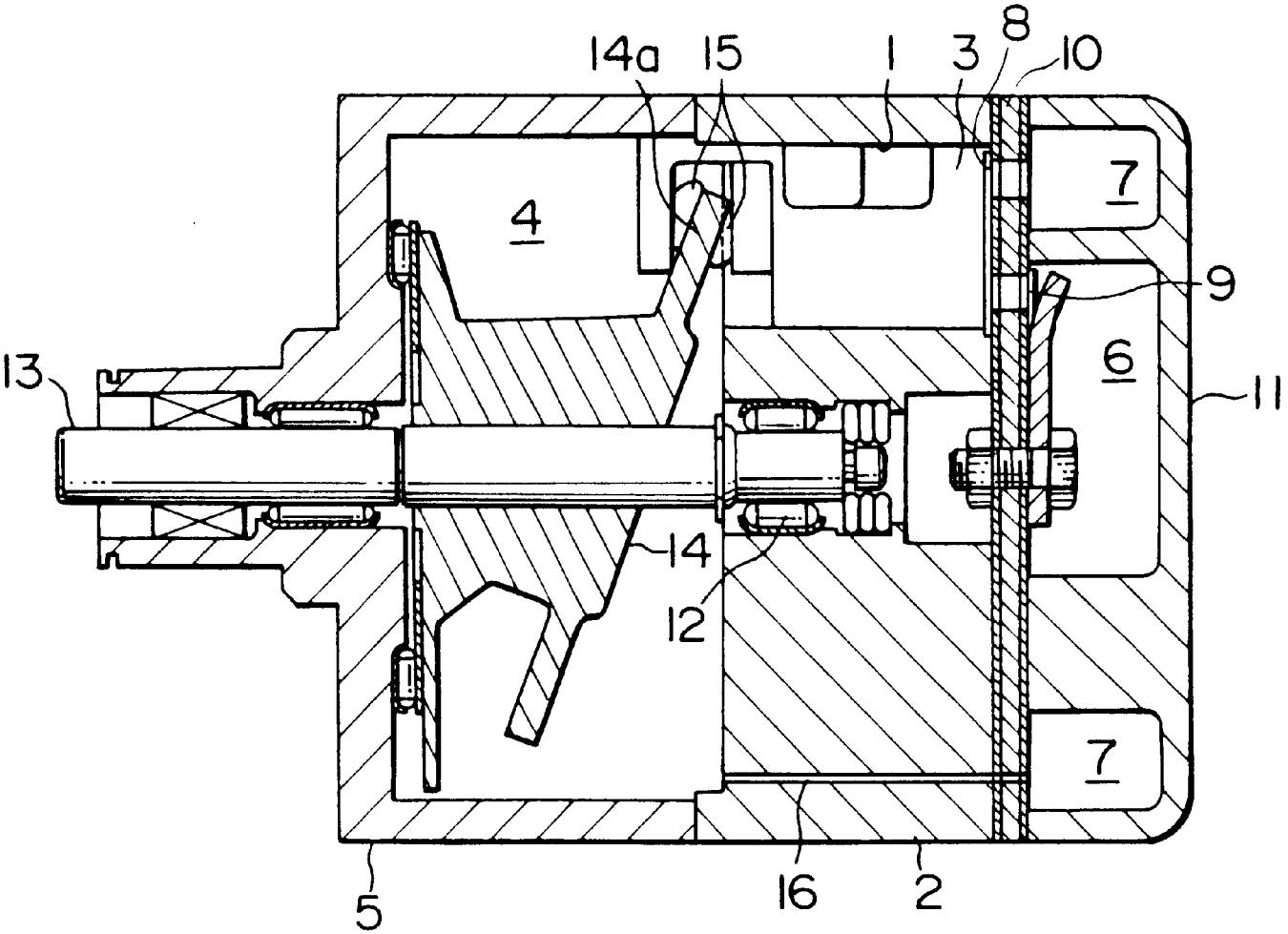
FIG. 1 PRIOR ART
FIG. 1 is a vertical sectional view of a conventional reciprocating compressor.

In order to facilitate an understanding of this invention, conventional reciprocating compressors will at first be described with reference to the drawing.

Referring to FIG. 1, description will be directed to a first conventional reciprocating compressor disclosed in the first-mentioned publication (JP-A) No. 189897/1995. The first conventional reciprocating compressor comprises a cylinder block 2 with a plurality of cylinder bores 1 circumferentially formed around its center axis, a plurality of single-head pistons 3 disposed in the cylinder bores 1, respectively, a front housing 5 closing one end of the cylinder block 2 and defining a crank chamber 4, a rear housing 11 having a discharge chamber 6 and a suction chamber 7 formed therein in an inner area and an outer area in a radial direction, respectively, and closing the other end of the cylinder block 2 through a valve plate 10 having a suction valve 8 and a discharge valve 9, a drive shaft 13 extending through the crank chamber 4 and supported by the cylinder block 2 through a block-side bearing 12, and a swash-plate element 14 responsive to a rotary motion of the drive shaft 13 for driving a reciprocating motion of each of the single-head pistons 3 within each corresponding one of the cylinder bores 1.

In the first conventional reciprocating compressor illustrated in FIG. 1, the swash-plate element 14 is fixedly attached to the drive shaft 13 and has a peripheral portion 14*a* operatively coupled to one end of each of the single-head pistons 3 through a sliding element 15. When the drive shaft 13 is rotated, the swash-plate element 14 is also rotated to transmit drive force from the peripheral portion 14*a* to the single-head pistons 3.

Following the reciprocating motion of the single-head pistons 3, a gas such as a refrigerant is sucked from the suction chamber 7 through the suction valve 8 into the cylinder bores 1 and discharged from the cylinder bores 1 through the discharge valve 9 to the discharge chamber 6. During such operation, the gas leaks through a space between each single-head piston 3 and an internal surface of each cylinder bore 1 and enters into the crank chamber 4 as a blowby gas. Since a lubricating oil is accumulated in the crank chamber 4, the blowby gas typically comprises a mixture of the lubricating oil and the refrigerant.

In order to return the blowby gas back into the suction chamber 7, a gas passage 16 is formed through the cylinder block 2 and the valve plate 10. The gas passage 16 extends from the suction chamber 7 substantially in parallel to the drive shaft 13 to an open end formed in the vicinity of an inner peripheral surface of the crank chamber 4.

Figure 2:
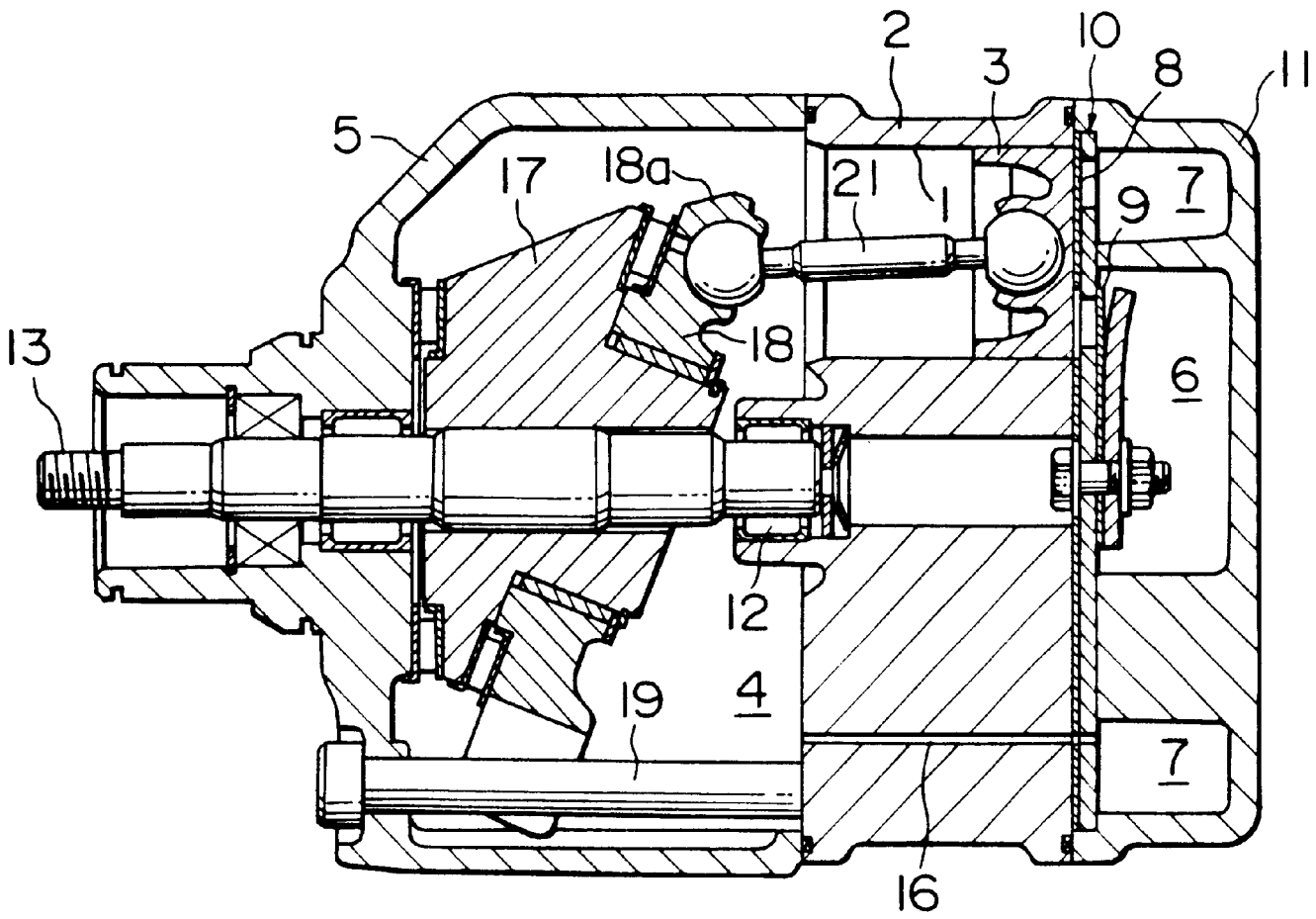
FIG. 2 PRIOR ART
FIG. 2 is a vertical sectional view of another conventional reciprocating compressor.

Referring to FIG. 2, the description will be directed to a second conventional reciprocating compressor disclosed in the second-mentioned publication (JP-A) No. 77158/1995. The second conventional reciprocating compressor is similar in structure to the first conventional reciprocating compressor except a part which will be described hereinafter. Similar parts are designated by like reference numerals and will not be described any longer.

The second conventional reciprocating compressor illustrated in the figure comprises a rotor 17 fixedly attached to the drive shaft 13, and a wobble plate 18 as a separate component separate from the rotor 17. A combination of the rotor 17 and the wobble plate 18 forms a swash-plate element. The wobble plate 18 is coupled to the rotor 17 through various bearings and inhibited by a rotation stopper mechanism 19 from being rotated relative to the front housing 5. The wobble plate 18 has a peripheral portion 18*a* operatively coupled to the single-head pistons 3 through piston rods 21.

In the second conventional reciprocating compressor also, the gas passage 16 is formed through the cylinder block 2 and the valve plate 10. The gas passage 16 extends from the suction chamber 7 substantially in parallel to the drive shaft 13 and has the open end formed in the vicinity of the inner peripheral surface of the crank chamber 4.

Each of the first and the second conventional reciprocating compressors is disadvantageous as described above.

Figure 3:
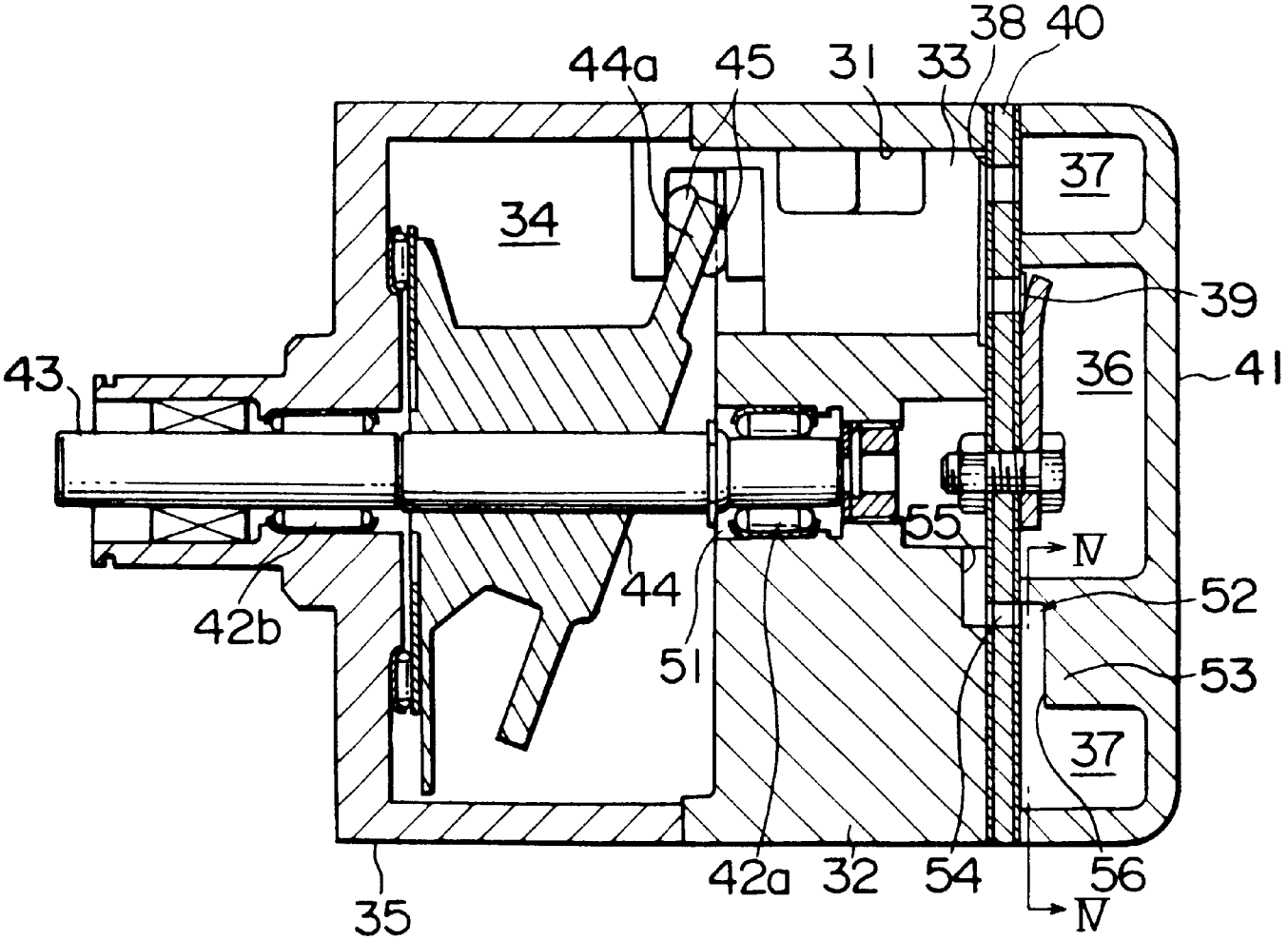
FIG. 3 is a vertical sectional view of a reciprocating compressor according to an embodiment of this invention.

Referring to FIG. 3, a reciprocating compressor according to one embodiment of this invention will be described. The reciprocating compressor comprises a cylinder block 32 with a plurality of cylinder bores (only one being illustrated in the figure) 31 circumferentially formed around its center axis extending in an axial direction. Each of the cylinder bores 31 extends in the axial direction. Within each of the cylinder bores 31, a single-head piston 33 is disposed. The cylinder block 32 has one end closed by a front housing 35 to define a crank chamber 34. The other end of the cylinder block 32 is closed by a rear housing 41 through a valve plate 40 having a suction valve 38 and a discharge valve 39. Within the rear housing 41, a discharge chamber 36 is formed in an inner area and a suction chamber 37 is formed in an outer area to surround the discharge chamber 36. During compressing operation, the discharge chamber 36 and the suction chamber 37 communicate with each cylinder bore 31 through the discharge valve 39 and the suction valve 38, respectively.

The reciprocating compressor further comprises a drive shaft 43 extending along the center axis. The drive shaft 43 extends through the front housing 35 into the crank chamber 34 to its one end supported by the cylinder block 32 through a block-side bearing 42*a*. The drive shaft 43 has the other end supported by the front housing 35 through a front-side bearing 42*b*. In the illustrated embodiment, each of the block-side bearing 42*a* and the front-side bearing 42*b* comprises a radial needle bearing.

To the drive shaft 43, a swash-plate element 44 is fixedly attached. The swash-plate element 44 has a peripheral portion 44*a* inclined with respect to the drive shaft 43. The peripheral portion 44*a* is operatively coupled to one end of each single-head piston 33 through a sliding element 45. When the drive shaft 43 is rotated, the swash-plate element 44 is also rotated to transmit drive force from the peripheral portion 44*a* to the single-head pistons 3. In this manner, each single-head piston 33 is driven to reciprocate within each cylinder bore 31.

During the operation, a blowby gas leaks through a space between each single-head piston 33 and an internal surface of each cylinder bore 31 into the crank chamber 34. In order to lead the blowby gas back into the suction chamber 37 through a gap inevitably left between the drive shaft 43 and the block-side bearing 42*a*, a gas passage is formed which will hereafter be described.

Figure 4:
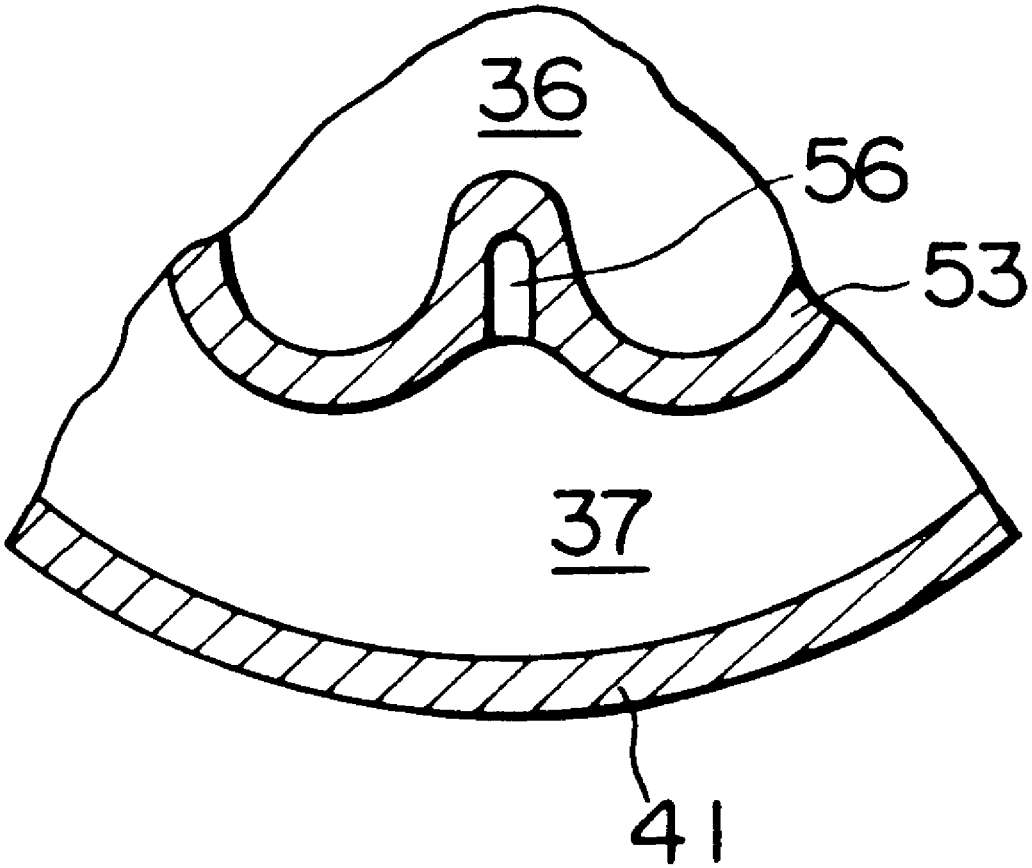
FIG. 4 is a sectional view taken along a line IV—IV in FIG. 3.

Referring to FIG. 4 in addition to FIG. 3, the cylinder block 32 has a bearing hole 51 extending therethrough in the axial direction and receiving the block-side bearing 42*a* therein. It is noted here that the bearing hole 51 is provided in the cylinder block of each of the conventional reciprocating compressors. Thus, no additional step is required to form the bearing hole 51 which serves as a part of the gas passage in this invention.

In order to lead the blowby gas through the bearing hole 51 into the suction chamber 37, a gas return path 52 is formed which extends from the bearing hole 51 through the valve plate 40 to the suction chamber 37.

Specifically, the rear housing 41 has a partitioning portion 53 formed between the discharge chamber 36 and the suction chamber 37. The valve plate 40 is provided with a through hole 54 formed at a position facing the partitioning portion 53. The cylinder block 32 is provided with a block-side groove 55 extending along the valve plate 40 to establish communication between the bearing hole 51 and the through hole 54. On the other hand, the partitioning portion 53 is provided with a partition-side groove 56 extending along the valve plate 40 to establish communication between the suction chamber 37 and the through hole 54. Thus, a combination of the through hole 54, the block-side groove 55, and the partition-side groove 56 forms the gas return path 52.

With this structure, the blowby gas within the crank chamber 34 is returned into the suction chamber 37 by a pressure difference between the crank chamber 34 and the suction chamber 37. Specifically, the blowby gas is introduced into the bearing hole 51 formed at the center of the crank chamber 34 and passes through the gap between the block-side bearing 42*a* and the drive shaft 43 to reach an area adjacent to the valve plate 40. Then, the blowby gas passes through the gas return path 52 formed by the through hole 54, the block-side groove 55, and the partition-side groove 56 to flow into the suction chamber 37.

Figure 5:
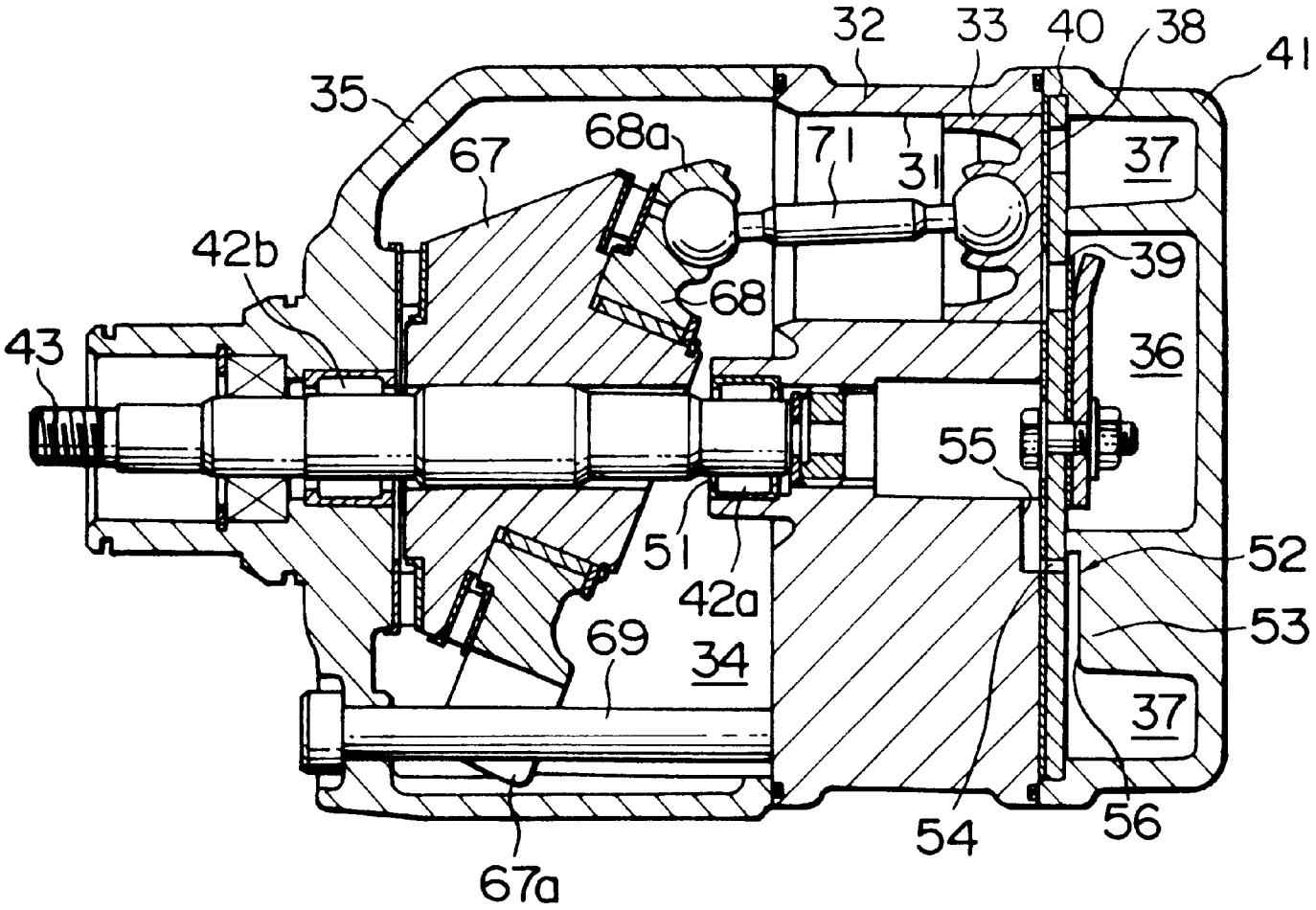
FIG. 5 is a vertical sectional view of a reciprocating compressor according to another embodiment of this invention.

Referring to FIG. 5, a reciprocating compressor according to another embodiment of this invention is similar in structure to that illustrated in FIG. 3 except a part which will hereafter be described. Similar parts are designated by like reference numerals and will not be described any longer.

The reciprocating compressor illustrated in FIG. 5 comprises a rotor 67 fixedly attached to the drive shaft 43, and a wobble plate 68 as a separate component separate from the rotor 67. A combination of the rotor 67 and the wobble late 68 forms a swash-plate element. The wobble plate 68 is coupled to the rotor 67 through various bearings and has a portion 67*a* engaged with a rotation stopper mechanism 69 in a rotating direction of the rotor 67. Thus, the wobble plate 68 is inhibited from being rotated together with the rotor 67 relative to the front housing 35. The wobble plate 68 has a peripheral portion 68*a* operatively coupled to the single-head pistons 33 through piston rods 71.

In the reciprocating compressor of this embodiment also, the blowby gas is introduced into the bearing hole 51 formed at the center of the crank chamber 34 and passes through the gap between the block-side bearing 42*a* and the drive shaft 43 to reach the area adjacent to the valve plate 40. Then, the blowby gas passes through the gas return path 52 formed by the through hole 54, the block-side groove 55, and the partition-side groove 56 to flow into the suction chamber 37.

Each of the reciprocating compressors of FIGS. 3 and 5 has a structure in which the blowby gas to be returned to the suction chamber is introduced into the gap around the block-side bearing located at the center of the crank chamber. Therefore, irrespective of an installation angle of the compressor, the lubricating oil hardly returns to the suction chamber and rather accumulates within the crank chamber. Thus, it is possible to return the blowby gas back into the suction chamber with the lubricating oil within the crank chamber kept at a sufficient level. Therefore, lubricity of the swash-plate element and the driving elements is improved. In addition, it is unnecessary to form any additional through hole penetrating the cylinder block in the axial direction.

While the present invention has thus far been described in conjunction with a few embodiments thereof, it will be possible for those skilled in the art to put this invention into practice in various other manners. For example, although only one gas return path is shown in the figure, it will readily be understood that a plurality of like gas return paths can be formed. As the block-side bearing, use may be made of not only the radial needle bearing but also any other bearing as far as the gap sufficient to permit the passage of the blowby gas is assured.

What is claimed is:

1. A reciprocating compressor comprising:

a cylinder block having a cylinder bore and a bearing hole;

a piston disposed in said cylinder bore;

a front housing placed at one end of said cylinder block in an axial direction to define a crank chamber in cooperation with said cylinder block;

a drive shaft penetrating said front housing and driven to have a rotary motion;

a block-side bearing supporting said drive shaft in said bearing hole;

a swash-plate element placed in said crank chamber and responsive to said rotary motion of the drive shaft for making said piston have a reciprocating motion within said cylinder bore;

a rear member placed at another end of said cylinder block in said axial direction and having a discharge chamber and a suction chamber which are communicable with said cylinder bore in response to said reciprocating motion of the piston; and a gas return path connected to said bearing hole and said suction chamber for returning a blowby gas, which leaks into said crank chamber from said bore, back into said suction chamber through a gap left between said drive shaft and said block-side bearing, wherein said bearing hole directly communicates with said crank chamber.

2. A reciprocating compressor as claimed in claim 1, wherein said rear member comprises:

a rear housing arranging said discharge and said suction chambers in a radial direction perpendicular to said axial direction; and a valve plate placed between said cylinder block and said rear housing for controlling communication between said cylinder bore and each of said discharge and said suction chambers, said bearing hole penetrating said cylinder block in said axial direction, said gas returning means having a gas return path extending from said bearing hole through said valve plate to said suction chamber.

3. A reciprocating compressor comprising:

a cylinder block having a cylinder bore and a bearing hole;

a piston disposed in said cylinder bore;

a front housing placed at one end of said cylinder block in an axial direction to define a crank chamber in cooperation with said cylinder block;

a drive shaft penetrating said front housing and driven to have a rotary motion;

a block-side bearing supporting said drive shaft in said bearing hole;

a swash-plate element placed in said crank chamber and responsive to said rotary motion of the drive shaft for making said piston have a reciprocating motion within said cylinder bore;

a rear member placed at another end of said cylinder block in said axial direction and having a discharge chamber and a suction chamber which are communicable with said cylinder bore in response to said reciprocating motion of the piston; and a gas return path connected to said bearing hole and said suction chamber for returning a blowby gas, which leaks into said crank chamber from said bore, back into said suction chamber through a gap left between said drive shaft and said block-side bearing;

wherein said rear member comprises:

a rear housing arranging said discharge and said suction chambers in a radial direction perpendicular to said axial direction; and a valve plate placed between said cylinder block and said rear housing for controlling communication between said cylinder bore and each of said discharge and said suction chamber, said bearing hole penetrating said cylinder block in said axial direction, said gas return path extending from said bearing hole through said valve plate to said suction chamber;

further wherein said rear housing has a partitioning portion between said discharge chamber and said suction chamber, said valve plate being provided with a through hole formed at a position facing said partitioning portion, said cylinder block being provided with a block-side groove extending along said valve plate to establish communication between said bearing hole and said through hole, said partitioning portion having a partition-side groove extending along said valve plate to establish communication between said suction chamber and said through hole, a combination of said through hole, said block-side groove, and said partition-side groove forming said gas return path.

4. A reciprocating compressor as claimed in claim 3, wherein said suction chamber extends to surround said discharge chamber.

5. A reciprocating compressor comprising:

a cylinder block having a plurality of cylinder bores and a bearing hole;

a plurality of pistons disposed in said cylinder bores, respectively;

a front housing placed at one end of said cylinder block in an axial direction to define a crank chamber in cooperation with said cylinder block;

a drive shaft penetrating said front housing and driven to have a rotary motion;

a block-side bearing supporting said drive shaft in said bearing hole;

a swash-plate element placed in said crank chamber and responsive to said rotary motion of the drive shaft for making each of said pistons have a reciprocating motion within each of said cylinder bores;

a rear member placed at another end of said cylinder block in said axial direction and having a discharge chamber and a suction chamber which are communicable with each of said cylinder bores in response to said reciprocating motion of the respective piston; and gas returning means connected to said bearing hole and said suction chamber for returning a blowby gas, which leaks into said crank chamber from said bore, back into said suction chamber through a gap left between said drive shaft and said block-side bearing, wherein said bearing hole directly communicates with said crank chamber.

6. A reciprocating compressor as claimed in claim 5, wherein said plurality of cylinder bores numbers two or more, and further wherein said plurality of pistons numbers two or more.

7. A reciprocating compressor as claimed in claim 5, wherein said gas returning means is a gas return path.

8. A reciprocating compressor as claimed in claim 5, wherein said rear member comprises:

a rear housing arranging said discharge and said suction chambers in a radial direction perpendicular to said axial direction; and a valve plate placed between said cylinder block and said rear housing for controlling communication between said plurality of cylinder bores and each of said discharge and said suction chamber, said bearing hole penetrating said cylinder block in said axial direction, said gas returning means extending from said bearing hole through said valve plate to said suction chamber.

* * * * *